US006892534B2

(12) United States Patent
Silva et al.

(10) Patent No.: US 6,892,534 B2
(45) Date of Patent: May 17, 2005

(54) ELECTRO-HYDROSTATIC ACTUATOR WITH A FAILSAFE SYSTEM

(75) Inventors: Gabriel Silva, Liverpool, NY (US); David Faso, Cazenovia, NY (US)

(73) Assignee: Young & Franklin Inc., Liverpool, NY (US)

( * ) Notice: Subject to any disclaimer, the term of this patent is extended or adjusted under 35 U.S.C. 154(b) by 128 days.

(21) Appl. No.: 10/622,949

(22) Filed: Jul. 18, 2003

(65) Prior Publication Data

US 2005/0011188 A1 Jan. 20, 2005

(51) Int. Cl.[7] ..... F15B 1/00

(52) U.S. Cl. ..... 60/404; 60/405; 60/406; 60/476

(58) Field of Search ..... 60/403, 404, 405, 60/406, 476

(56) References Cited

U.S. PATENT DOCUMENTS 2,631,431 A * 3/1953 Grebe ..... 60/477
3,203,183 A * 8/1965 Lucien ..... 60/403
5,577,532 A * 11/1996 Palmer ..... 137/460
5,950,427 A * 9/1999 Demerjian et al. ..... 60/404
6,625,982 B2 * 9/2003 Van Den Bossche et al. . 60/403

* cited by examiner

*Primary Examiner*—Thomas E. Lazo
(74) *Attorney, Agent, or Firm*—Wall Marjama & Bilinski LLP

(57) ABSTRACT

An electro-hydrostatic actuator unit that contains a sealed pressurized housing filled with a dielectric fluid. A bi-directional motor is immersed in the fluid and drives a gear pump for exchanging fluid via a control circuit between the chambers of a bi-directional hydraulic actuator in response to an input from a controller. The chambers are separated by a piston and a piston rod is connected to an external load such as a plunger type valve. A failsafe circuit is also provided which is arranged to override the control circuit in the event a failsafe condition is detected by the unit controller. The failsafe circuit contains a motor driven pump that provides high pressure fluid from the pressurized reservoir to an accumulator. Valves are arranged to shut down the control circuit and deliver fluid from the accumulator to one of the cylinder chambers to rapidly move the actuator to a desired failsafe position. Both motor drive pumps, the actuator, cylinder, and the controller are fully immersed in the fluid reservoir.

16 Claims, 5 Drawing Sheets

ELECTRO-HYDROSTATIC ACTUATOR WITH A FAILSAFE SYSTEM

BACKGROUND OF THE INVENTION

The invention relates to an electro-hydrostatic actuator that is ideally suited to control the positioning of a valve or any other similar device.

More specifically, this invention relates to a compact electrically operated linear actuator that integrates all controls and components to provide rapid and efficient heat dissipation and cooling to all heat producing parts.

Current demands on power generation systems and valve controls require that the actuators be electrically controlled and include fail safe features. In many countries, linear actuator of the type herein disclosed also require certification when employed in an environment where an explosion might take place as for example in controlling valves utilized in gas or oil pipelines or in certain processing plants where volatile chemicals are used in the process. In order to gain certification, many of the actuators are housed in rather bulky complex structures and employ external power supplies and controls which are costly to construct and difficult to service and maintain in the field. Typically, the electronic controls of the actuator are designed to be located in separate remote housing having a non-hazardous controlled environment. The cabling between the actuator and the controller can be relatively long which can lead to signal transmission loses and other related difficulties.

The invention presented here provides a solution to electrical control actuation within a compact package and is designed to meet uniform cooling and protection for use in hazardous environments along with an integrated hydraulic failsafe system for rapidly bringing the actuator to a shut down position when a potentially hazardous situation is sensed.

In U.S. Pat. No. 2,631,431 to Gerbe, there is disclosed an electro-hydraulic actuator in which an electric motor is located in a tank filled with oil. The motor is equipped with a hollow shaft and the shaft of a pump impeller is slidably contained within the hollow motor shaft. The impeller of the motor is arranged so that it can turn with the motor shaft while at the same time moving longitudinally along the axis of the shaft. The pump impeller is situated inside a hollow piston that is secured to a piston rod. The piston rod extends upwardly and passes out of the tank. In operation, the motor drives the impeller at a speed to increase the pressure of the oil on one side of the piston to a desired level wherein the piston and piston rod are displaced upwardly to position a linear device that is secured to the piston rod. A weight or spring is used to return the piston to its home position when the motor is de-energized.

Although the Gerbe device provides for improved motor cooling, the electronic controls for the motor are situated at a location remote from the tank that houses the motor and is therefore subject to all the problems associated with transmission lines of any appreciable length. Furthermore, because the electrical unit associated with the actuator must be housed in its own hazardous area container, the system is rather costly to build and maintain. The Gerbe device does not include a failsafe feature.

SUMMARY OF THE INVENTION

It is therefore a primary object of the present invention to improve electro-hydrostatic actuators.

It is a further object of the present invention to package both the electrical and mechanical components of an electro-hydrostatic actuator including a failsafe system in a single non-hazardous environment.

A still further object of the present invention to provide fluid cooling to both the mechanical and electrical components of an electro-hydrostatic actuator.

Another object of the present invention is to provide a more compact, hazardous area valve actuator that includes a failsafe system.

Yet another object of the present invention is to reduce transmission loss of the type generally found in electro-hydrostatic valve actuator units.

Still another object of the present invention is to immerse the electrical and mechanical components of an electro-hydraulic actuator in a reservoir of dielectric oil along with a hydraulic failsafe system.

These and other objects of the present invention are attained by an electro-hydrostatic actuator having a pressurized sealed housing containing a reservoir of dielectric fluid. A motor driven pump and electrical circuitry for controlling the pump are all immersed in the fluid contained within the reservoir. An electrical controller is also immersed in the reservoir for regulating the pump motor so that the pump delivers fluid from the reservoir to a hydraulic cylinder to move the piston rod of the cylinder to a desired location along the stroke path of the piston. Also immersed in the reservoir is a fluidic failsafe system that is arranged to rapidly bring the actuator to a shut off position when a potentially hazardous condition is sensed. Fluid for the failsafe system is also drawn from the reservoir.

BRIEF DESCRIPTION OF THE DRAWING

For a further understanding of these and objects of the present invention, reference will be made to the following detailed description of the invention which is to be read in association with the accompanying drawings, wherein.

DETAILED DESCRIPTION OF THE INVENTION

Figure 1:
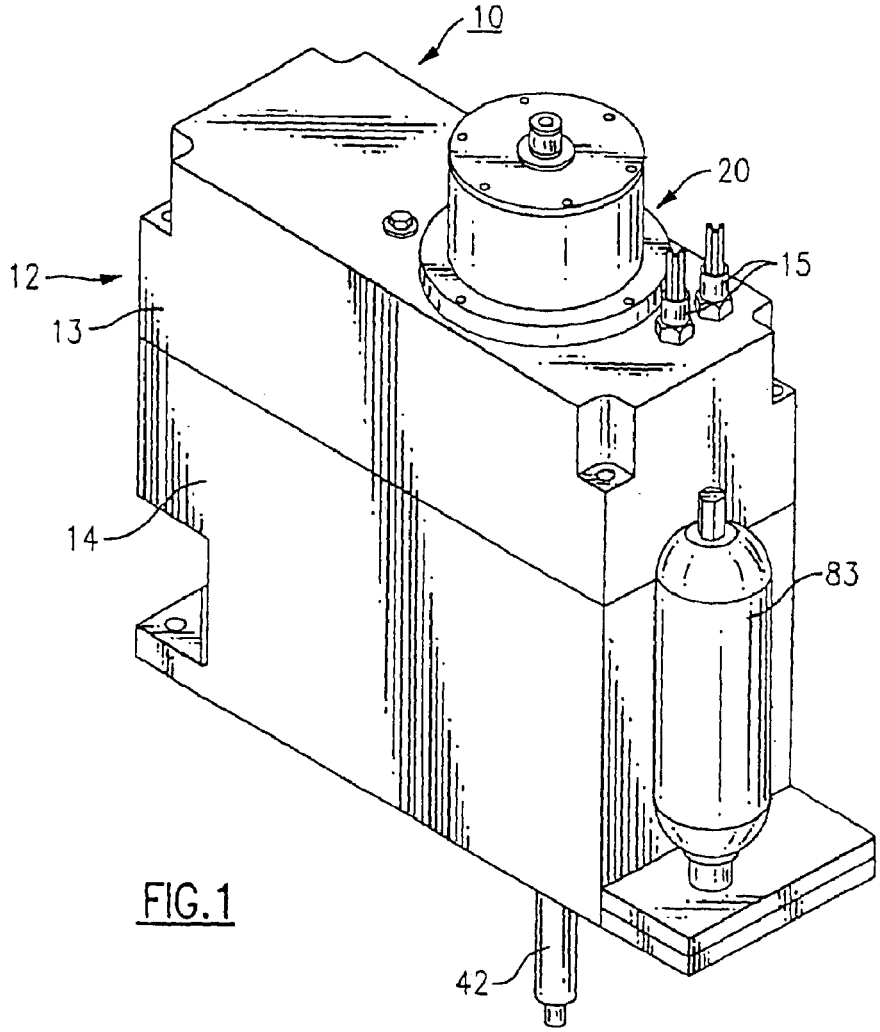
FIG. 1 is a perspective view illustrating an electro-hydrostatic actuator unit embodying the present invention.
Figure 3:
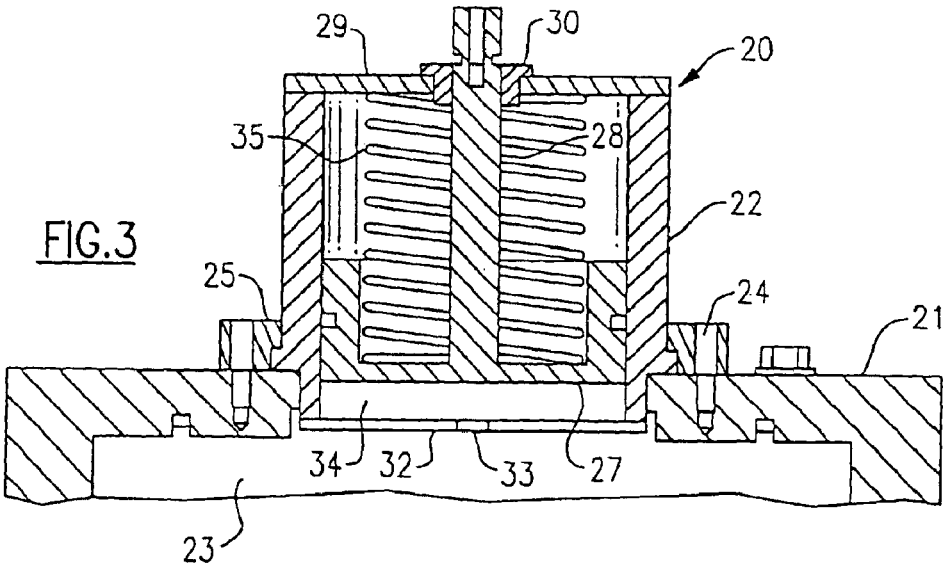
FIG. 3 is an enlarged partial view in section showing a pressure compensating unit employed in the practice of the present invention.
Figure 2:
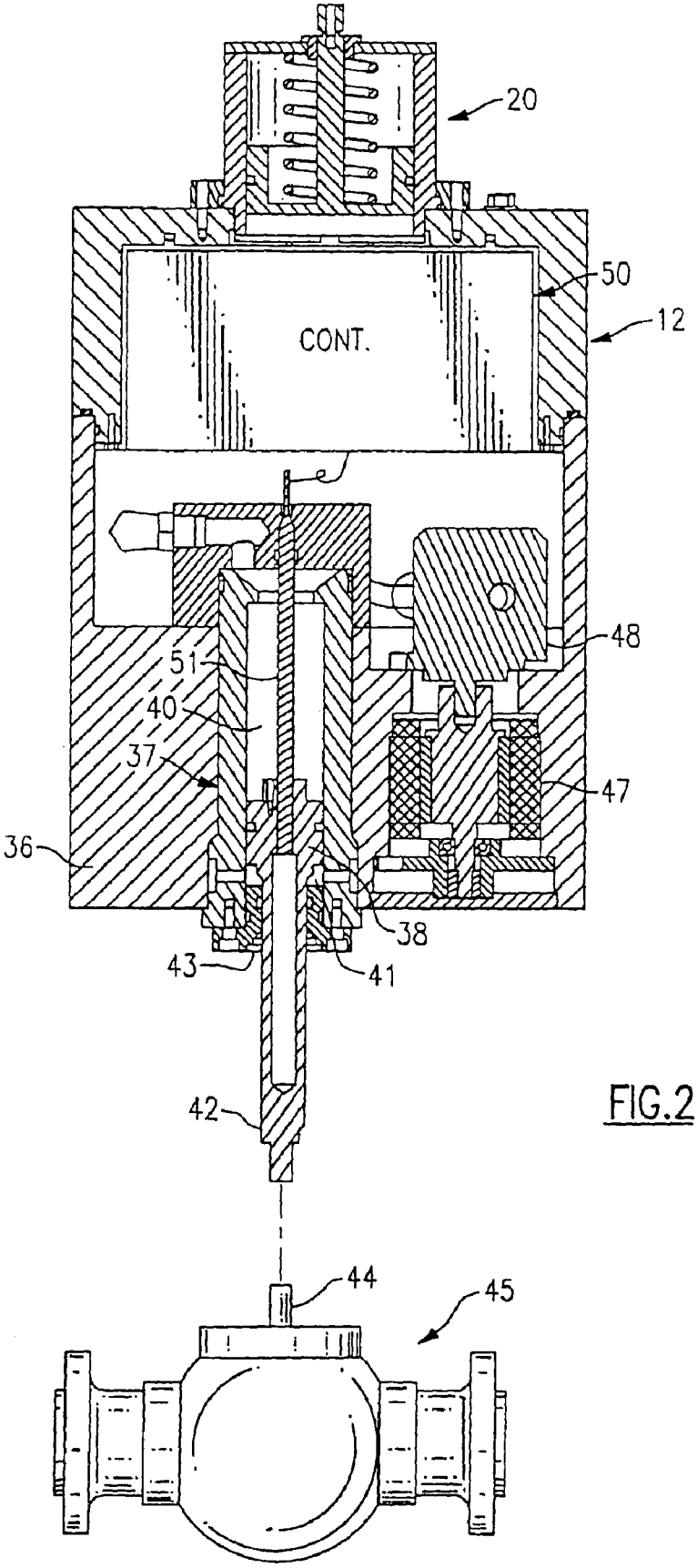
FIG. 2 is a side elevation in section of the actuator unit illustrated in FIG. 1.

Turning initially to FIGS. 1–3 there is illustrated an actuator unit, generally referenced 10, that embodies the teachings of the present invention. The unit includes a two piece sealed housing 12 that includes an upper section 13 that is removably secured to a lower section 14. The housing is substantially filled with a dielectric fluid and appropriate seals are provided to prevent the fluid from escaping from the housing. Sealed electrical connectors 15—15 are mounted in the top wall 16 of the housing through which electrical lines pass into and out of the housing.

A pressure compensating unit 20 is also mounted in the top wall of the unit and is illustrated in greater detail in FIG. 3. The compensating unit provides a variable volume to the reservoir of the actuator unit to accommodate for fluid expansion and fluid surge. The compensating unit also functions to provide a positive pressure in the fluid reservoir. The unit is contained within a cylindrical vessel 22 that opens through the top wall 21 of the housing into the oil reservoir 23 of the housing 12 and is secured to the top wall of the housing by suitable means such a screws 24 that pass through a locking flange 25 of the vessel and are threaded into the top wall of the housing. Here again suitable seals are provided to prevent fluid from passing out of the housing. A piston 27 is situated inside the vessel and a close sliding fit is provided between the piston and the inner wall of the vessel. A piston rod 28 is secured to the piston and is arranged to pass upwardly through the top end wall 29 of the vessel. The piston rod is slidably contained within a bushing 30 mounted in the top end wall 29. A plate 32 containing an orifice 33 is secured to the bottom end of the vessel and is placed in contact with the fluid that is contained in the reservoir so that fluid in the reservoir can pass into the region 34 immediately below the piston. A compression spring 35 surrounds the piston rod and serves to bias the piston downwardly into the fluid contained in region 34 to create a desired fluid pressure within the reservoir. Alternatively, a low pressure accumulator may be operatively connected to the reservoir to perform the same function.

As illustrated in FIG. 2, the lower section 14 of the housing has a contoured base 36 that has a first vertically disposed opening in which a double acting hydraulic cylinder 37 is mounted. The hydraulic cylinder contains a piston 38 that divides the interior of the cylinder into two separate chambers, a first upper chamber 40 and a second lower chamber 41. A piston rod 42 that is connected to the piston passes through the bottom end wall of the cylinder and out of the housing through a seal bushing 43.

The piston rod can be coupled to any suitable device that requires linear actuation. As noted above, the actuator unit is ideally well suited for positioning the valve stem 44 of a plunger type valve 45.

A second vertically disposed opening is formed in the bottom end wall of the housing which contains a bi-directional d.c. brushless motor 47 that is arranged to drive a bi-directional gear pump 48. The motor includes a permanent magnet mounted upon the rotor section of the motor and winding situated upon the motor stator. The motor is designed to yield high energy density due to its low rotating inertia and has an improved thermal performance due to the windings having a direct thermal path to the exterior of the motor casing. The brushless motor is commutated by an electronic controller 50 rather than the more conventional brush and commutator arrangement. As a result there are no brushes to wear out and little if any required maintenance over the life of the motor.

The controller 50 is mounted in the upper part of the housing and is also completely immersed in the fluid reservoir. The housing, in turn, is fabricated of a material having a high co-efficient of heat transfer. Accordingly, any heat that is generated by the electronics, the motor and the hydraulic cylinder is absorbed by the fluid and rapidly passed through the housing walls to the surrounding ambient.

A linear position transducer 51 is operatively connected to the piston rod of the cylinder which provides positioning data to the controller and as will be explained below in further detail the controller is able to extend or retract the piston rod to any desired position within the available stroke of the cylinder.

A second d.c. motor 52 and its associated pump 53 are similarly mounted in the base of the housing adjacent to the hydraulic cylinder. The motor and the pump are shown schematically in FIGS. 4–6 and like the first pump and motor combination this second combination is also immersed in the fluid function of this second pump and motor combination will be explained in further detail below.

Figure 4:
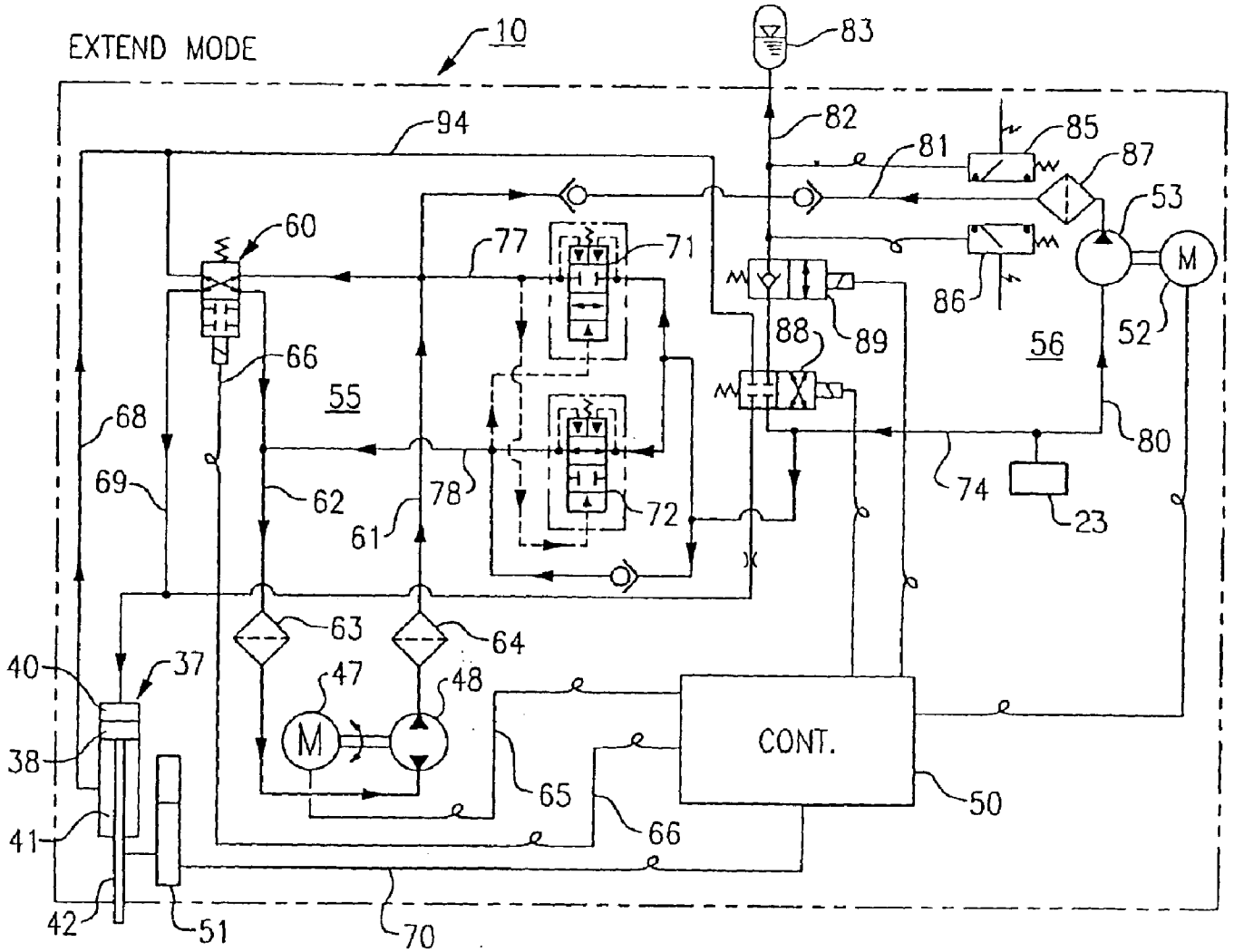
FIG. 4 is a schematic representation illustrating the controls of the unit in a cylinder extend mode of operation.
Figure 5:
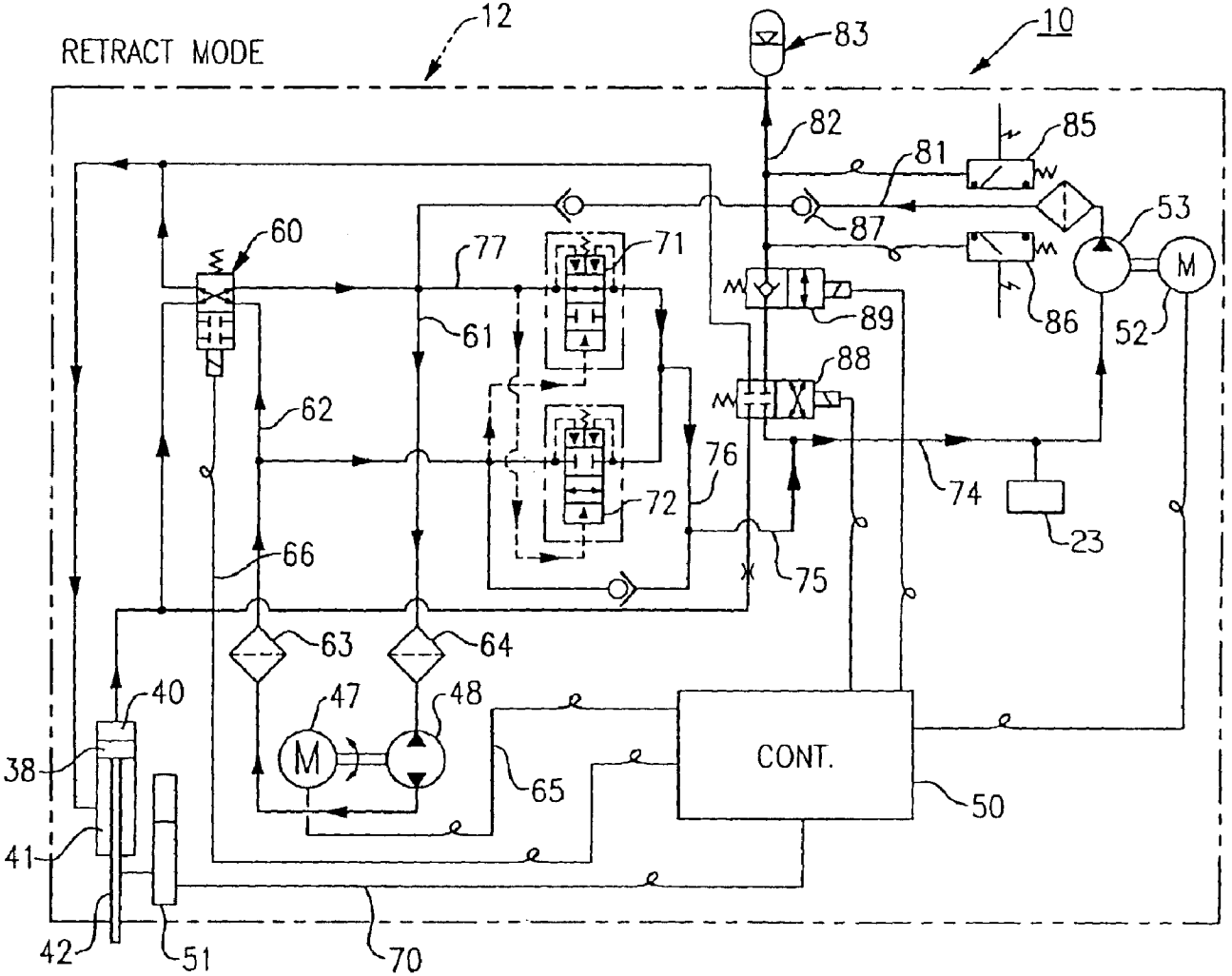
FIG. 5 is a schematic representation illustrating the controls of the unit in a cylinder retract mode of operation.
Figure 6:
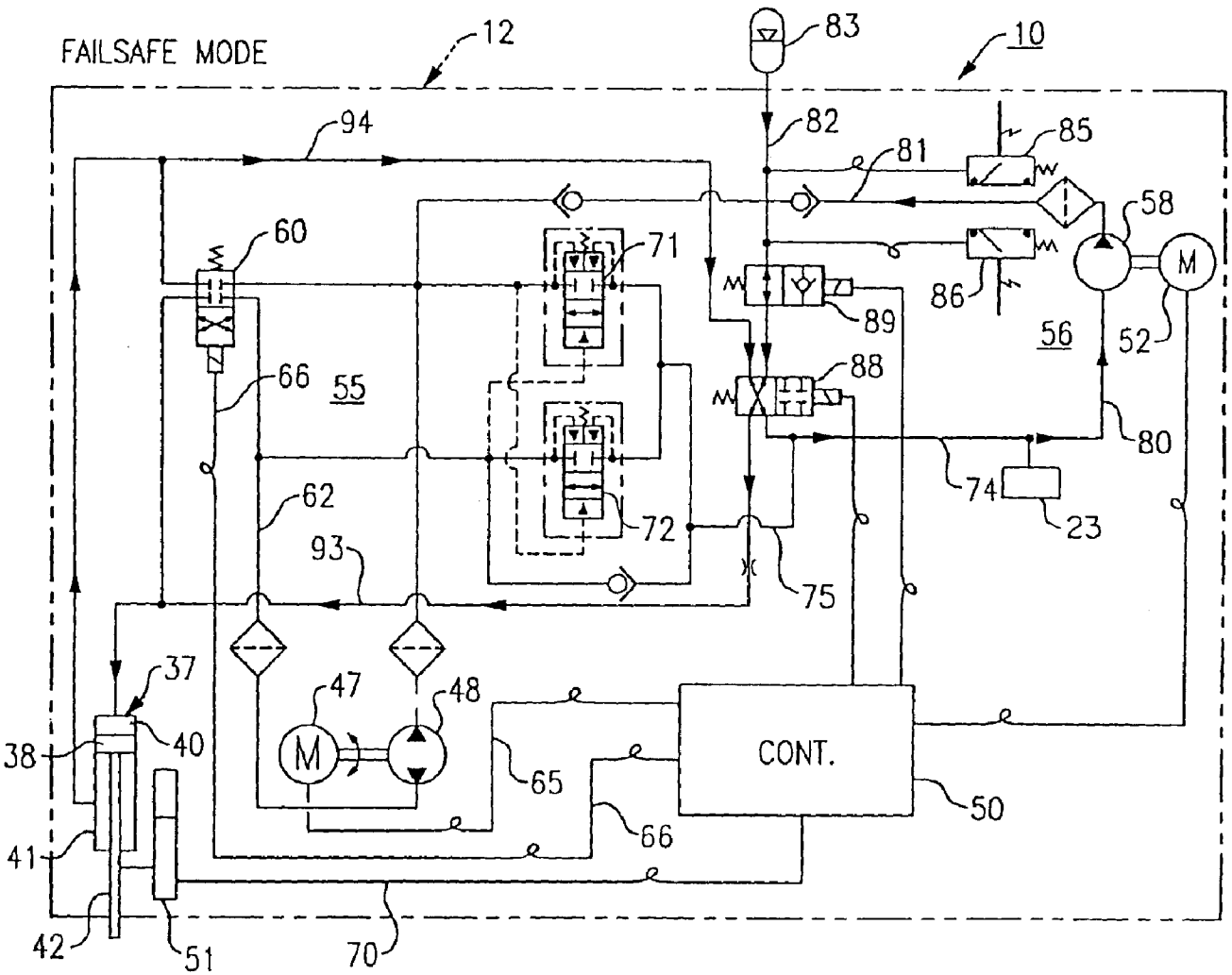
FIG. 6 is a schematic representation illustrating the controls of the unit in the actuator in a failsafe mode of operation.

Turning now to FIGS. 4–6, there is shown in schematic form the functional components of the present actuator unit. Basically, the unit has three operational modes that include a cylinder extension mode that is illustrated in FIG. 4, a cylinder retraction mode that is illustrated in FIG. 5 and a failsafe mode that is illustrated in FIG. 6. The unit is divided into two sections which will be referred to herein the actuator control section 55 and the failsafe section 56.

A solenoid actuated cylinder flow control valve 60 is contained in the circuitry of the control section which functions to allow fluid to be exchanged between the two chambers of the actuator cylinder. The flow control valve is connected to both sides of the gear pump 48 by flow lines 61 and 62. Filters 63 and 64 are placed in the flow lines to remove any contaminants that might find their way into the fluid. The flow control valve is normally closed when in a de-energized condition. When the piston rod extension mode is selected by the controller, the control valve is energized and thus opened upon receiving a signal from the controller 50 via electrical line 66.

When in the cylinder extend mode of operation, the motor 47 is instructed by the controller via electrical lead 66 to turn in a direction so that fluid is drawn from chamber 41 via flow line 68, through the now open control valve and back to the low pressure side of the pump via flow line 62. The pressure in the fluid is then raised by the pump and is returned to cylinder chamber 40 through lines 61 and 69 causing the piston to move downwardly and thus extending the piston rod outwardly from the cylinder.

The position of the piston rod is sensed by the linear position transducer 51 and this data is delivered to the controller via electrical line 70. When the piston rod has moved to the desired extended position, the motor 47 will slow down the driving pump 48 so that the pump provides sufficient flow to overcome internal leakage and to maintain the desired piston rod position.

As illustrated in FIG. 5, selection of the piston rod retraction mode causes the controller to reverse the rotation of the bi-directional motor 47 and to again open the flow control valve 60 whereupon the flow of fluid through the control circuitry is reversed so that low pressure fluid is drawn from cylinder chamber 40 and high pressure fluid from the pump 48 is delivered into cylinder chamber 41 thus retracting the piston rod into the cylinder. Again, the position of the piston rod is sensed by the linear position transducer 51 and when the desired position is reached, the rotation of the pump 48 slows down to produce flow that is sufficient to overcome internal leakage, and maintain the desired position.

The flow control circuit is connected to the pressurized fluid in the reservoir 23 by means of two pressure actuated valves 71 and 72. One side of each pressure actuated valve is connected directly to the pressurized fluid in reservoir 23 by flow lines 74, 75 and 76. The opposite side of pressure actuated valve 71, in turn, is connected into flow line 61 in the flow control circuit while pressure actuated valve 72 is connected into flow line 62. The pressure actuated valves are normally closed when pump 48 is inactive. The pressure activated valves are arranged so that when the pump is activated, the valve on the low pressure side of the pump will open and the valve on the high pressure side of the pump will remain closed. The pressure difference between the reservoir and the low pressure side of the pump is such that fluid in the low pressure reservoir 23 will be permitted to enter or exit the flow control circuit to accommodate the difference in volumes 40 and 41 as well as making up any fluid that is lost from the circuit due to leaks and the like. Upon closing of the control valve, shutting down of the flow control circuit, and motor 47, both pressure actuated valves move to a closed position.

Although, not shown, data is provided to the controller relating to one or more hazardous conditions which, if detected, require the cylinder to be moved rapidly to a position wherein the plunger valve 45 will be moved to an inoperative failsafe position. In this case, the piston rod will be moved to a fully extended position to close the valve. In other applications, the failsafe position might however, be one wherein the piston rod is moved to a fully retracted position.

The failsafe circuit 56 for carrying out the failsafe mode of operation is illustrated in FIG. 6. As noted above, the failsafe circuit includes a second motor 52 that drives a unidirectional gear pump 53. The suction side of the pump is connected to the pressurized reservoir 23 by a suction line 80. The discharge line 81 of the pump is connected to a high pressure accumulator 83 by means of a supply line 82. A check valve 87 is mounted in the supply line which serves to isolate the accumulator pump from the accumulator when the pump 53 is idle. Pressure sensing switches 85 and 86 are situated in the accumulator line which are arranged to sense the fluid pressure in the line and thus the pressure within the accumulator. In the event, the pressure in the accumulator falls below a predetermined level the controller energizes motor 52 and the pump delivers high pressure fluid from the low pressure accumulator to the high pressure accumulator.

In practice, the pressurized reservoir can be replaced by an accumulator. The two accumulators can be mounted either inside or outside the unit housing 12. However, because of space considerations, it is preferred that the accumulators be located outside the housing as illustrated in FIG. 1.

A solenoid actuated failsafe control valve 88 is mounted in flow line 82 and a solenoid actuated poppet valve 89 is placed in the line between the high pressure accumulator and the failsafe control valve. The two valves 88 and 89 are energized and thus closed during normal operation of the actuator. When the valves are closed the poppet valves shield the control valve from the high pressure in the high pressure accumulator thus minimizing the danger of the failsafe control valve from developing leaks.

In the event a failsafe condition is sensed, the controller de-energizes both the poppet valve 89 and the failsafe control valve 88 via electrical lines 90 and 91 thus opening both valves. At the same time, pumps 47 and 52 are shut down and flow control valve 60 is closed. Closing valve 88 places the high pressure accumulator in communication with chamber 40 of the actuator cylinder by means of the accumulator line 82 and supply line 93. Cylinder chamber 41 at this time is placed in communication with the pressurized reservoir accumulator through means of return line 94, valve 88 and line 74.

While the present invention has been particularly shown and described with reference to the preferred mode as illustrated in the drawing, it will be understood by one skilled in the art that various changes in detail may be effected therein without departing from the spirit and scope of the invention as defined by the claims.

We claim:

1. An electro-hydrostatic actuator unit that includes a sealed pressurized reservoir that is filled with a dielectric fluid, an actuator that includes a hydraulic cylinder that contains a movable piston for separating the interior of said cylinder into a first chamber and a second chamber and a piston rod for connecting the piston to an external load, a bidirectional pump that is immersed in said reservoir said bidirectional pump being operatively connected into a cylinder flow control circuit for exchanging fluid between said chambers to either extend or retract said piston rod, a solenoid actuated directional valve that is mounted in the flow control circuit, said directional valve being in a closed position when de-energizing and an open position when energizing for routing fluid from one side of the piston to the other side of said piston, an accumulator pump that is immersed in said reservoir, said accumulator pump contained in a failsafe flow circuit for delivering pressurized fluid contained in said reservoir to a trip accumulator, a solenoid actuated trip valve mounted in the failsafe circuit, said trip valve being connected to one of said cylinder chambers by a trip line, said trip valve being closed when in an energized condition and opened when in a de-energized condition whereby pressurized fluid in the accumulator is delivered into said one chamber to move said piston rod to a desired position, control means that is immersed in said reservoir and being arranged to sense a failsafe condition and to de-energizing the directional valve and energizing said trip valve when a failsafe condition is sensed whereby the piston rod is moved to a desired failsafe position.

2. The electro-hydrostatic actuator unit of claim 1 wherein said bidirectional pump is a motor driven gear pump.

3. The electro-hydrostatic actuator unit of claim 2 wherein said gear pump is driven by a bidirectional motor which is also immersed in the reservoir.

4. The electro-hydrostatic actuator unit of claim 3 wherein said bidirectional pump is controlled by said controller.

5. The electro-hydrostatic actuator unit of claim 3 that further includes an accumulator pump motor that is also immersed in said reservoir and which is connected to said controller for driving said accumulator pump.

6. The electro-hydrostatic actuator unit of claim 5 that further includes pressure sensing means in said failsafe circuit for providing accumulator pressure data to the controller.

7. The electro-hydrostatic actuator unit of claim 6 wherein said accumulator pump motor is controlled by said controller to maintain the accumulator pressure at a desired level.

8. The electro-hydrostatic actuator unit of claim 1 wherein said cylinder is immersed in said reservoir and the distal end of said piston rod passes out of the reservoir and is connected to an external load.

9. The electro-hydrostatic actuator unit of claim 8 wherein said load is a stem of a plunger type valve.

10. The electro-hydrostatic actuator unit of claim 9 wherein said plunger type valve is moved to a specific position when a failsafe condition is sensed.

11. The electro-hydrostatic actuator unit of claim 1 that further includes position sensing means for detecting the position of said piston rod and providing position data to said controller.

12. The electro-hydrostatic actuator unit of claim 11 wherein said position sensing means is a linear position transducer for detecting the position of said piston rod providing position data to the controller.

13. The electro-hydrostatic actuator unit of claim 1 that includes a pair of pressure actuated valves mounted in the flow control circuit on either side of the bi-directional pump for connecting the pressurized reservoir to the flow control circuit, said pressure actuated valves being arranged so that a first valve on the high pressure side of the pump is closed and the pressure actuated valve on the low pressure side of the bi-directional pump is opened when the bi-directional pump is in operation whereby fluid can flow between the reservoir and the flow control circuit.

14. The electro-hydrostatic actuator unit of claim 13 wherein said accumulator pump is arranged to maintain the pressure in the accumulator at a level higher than that in the low pressure side of the flow control circuit.

15. The electro-hydrostatic actuator unit of claim 1 that further includes a solenoid actuated poppet valve that is mounted between the trip accumulator and the trip valve, said poppet being connected to the controller and arranged to open when said trip valve is opened.

16. The electro-hydrostatic actuator unit of claim 1 that further includes a compensating means for maintaining a positive pressure within the fluid reservoir.

* * * * *